US012544637B2

(12) United States Patent
Cooper

(10) Patent No.: US 12,544,637 B2
(45) Date of Patent: Feb. 10, 2026

(54) GAME PIECE TOSSING TARGET GAME

(71) Applicant: Patrick Cooper, Arcade, NY (US)

(72) Inventor: Patrick Cooper, Arcade, NY (US)

( * ) Notice: Subject to any disclaimer, the term of this patent is extended or adjusted under 35 U.S.C. 154(b) by 531 days.

(21) Appl. No.: 18/175,153

(22) Filed: Feb. 27, 2023

(65) Prior Publication Data

US 2024/0286016 A1 Aug. 29, 2024

(51) Int. Cl.
*A63B 67/06* (2006.01)
*A63B 63/08* (2006.01)

(52) U.S. Cl.
CPC ..... *A63B 63/08* (2013.01); *A63B 67/06* (2013.01); *A63B 2067/063* (2013.01)

(58) Field of Classification Search
None
See application file for complete search history.

(56) References Cited

U.S. PATENT DOCUMENTS 7,252,604 B2 * 8/2007 Birss ..... A63B 63/003 273/400
8,678,957 B1 * 3/2014 Essex ..... A63B 71/022 473/456
10,525,317 B2 * 1/2020 Esch ..... A63B 67/06
2008/0116644 A1 * 5/2008 Knoernschild ..... A63B 67/06 273/343
2024/0342568 A1 * 10/2024 McKinney ..... A63B 63/00

* cited by examiner

*Primary Examiner* — Sunit Pandya

(74) *Attorney, Agent, or Firm* — Colson Law Group, PLLC

(57) ABSTRACT

A game piece tossing game having a first plurality of offensive game targets, where each of the offensive targets comprises a playing surface and a target aperture within the playing surface, a second plurality of defensive game targets, where each of the defensive targets comprises a playing surface and a target aperture within the playing surface, at least one game piece, arranged to be tossed toward the playing surface of at least one of the offensive game targets, and preferably arranged to be tossed toward the target aperture within the playing surface of the at least one of the offensive game targets, wherein the first plurality of offensive game targets are arranged on a playing field by a first team, and the second plurality of defensive game targets are arranged on a playing field by a second team. A method of play is also disclosed.

26 Claims, 9 Drawing Sheets

GAME PIECE TOSSING TARGET GAME

FIELD

The present invention relates generally to a tossing game having at least one scoring target, at least one defensive target, and at least one game piece, and a corresponding method of play and, more specifically, to a tossing game with a football theme (in a preferred embodiment.)

BACKGROUND

Outdoor lawn games such as horseshoes, lawn darts, cornhole, and bocce are well known.

Cornhole, for example, (also known regionally as sack toss, or bean bag toss) is a lawn game in which players or teams take turns throwing fabric bean bags at a raised, angled board with an aperture therein. The goal of the game is to score points by either landing a bag on the board or putting a bag through the hole. Cornhole matches are played with two sets of four bags (eight total), two boards and two, four, or eight players.

There are four bags to a set. Each set of bags should be distinguishable from the other, usually by using different colors. Although bags used to be filled with preserved corn kernels (hence "cornhole") or dried beans, bags are now usually filled with plastic resin or other materials that will maintain a consistent weight and shape over many throws without deforming. Bags may be dual-sided, with each side of the bag being a different material that can affect grip and react faster or slower on the board's surface.

Each board is approximately two by four feet, with approximately a six-inch diameter aperture therein. In a preferred configuration of each board, the aperture's center is positioned about nine inches down from the center of a top edge of the board. Each board is angled with the top edge of the playing surface being arranged approximately 12 inches above the ground, and a bottom edge approximately three to four inches above the ground. A standard court places the two boards around 26 to 34 feet apart, measuring from the bottom edge of the boards.

The areas immediately to the left and right of the boards are the pitcher's boxes. The line (either drawn or imaginary) extends from the bottom edge of the board in both the left and right directions, is the foul line. When throwing the bags, players cannot step past the foul line or else the throw does not count.

A cornhole match is separated into innings (or frames). During each inning, each player or team will throw their designated four bags. The manner in which the bags are thrown depends on which format of cornhole is being played: singles (1 vs. 1), doubles (2 vs. 2), or crew (4 vs. 4).

In doubles (2 vs. 2), one partner from each team stands in the left pitcher's box of one board while the other partner stands in the right pitcher's box of the opposite board. Thus, each team's partners are on opposite ends, facing each other, both in the same lane. From here, the two opponents at one board alternate throwing their four bags at the other board, after which a mid-inning score is tallied; then their partners at that board alternate throwing their team's four bags back at the other board, after which the final inning score can be tallied. In doubles, players may not change sides, i.e., one partner will throw from the left pitcher's box of one board and the other from the right pitcher's box of the other board for the entire game.

To score points, bags must be on the surface of the board or fall through the aperture. To score three points, a bag may fall directly into the aperture, slide into the aperture after hitting the board, or be knocked into the aperture by another bag. A bag remaining on the board scores a single point. A bag partially on the board and partially on the ground ("dirt bag") does not count and should be removed before the next throw.

In cornhole, cancellation scoring is used. When the scores are tallied at the end of an inning, whichever player or team scores higher is awarded points equal to the difference between both sides. For example, if a first team scores 12 points in an inning and a second team scores 10 points, then the first team is awarded two points (i.e., 12 points minus 10 points); whereas if the first team and the second team both score 12 points, the difference is zero, and neither team scores. Play continues until one player or team reaches or exceeds 21 points at the end of an inning. By using cancellation scoring, it is only possible for one side (or neither side) to score in any inning, so match ties are impossible.

Various iterations of cornhole, and similar game piece tossing games, are known in the art. For example, U.S. Patent Publication No. 2012/0038108 (hereinafter "McLaughlin, Jr.") discloses a cornhole-type tossing game with a football theme arranged on the board, where the board includes a plurality of apertures. McLaughlin, Jr. does not disclose a plurality of multiple target areas, nor a plurality of offensive targets and defensive targets.

In another example, U.S. Pat. No. 11,192,010 (hereinafter "Areskog et al.") generally discloses a portable outdoor game kit or tossing game. The tossing game includes a boundary rope that is used to designate a general target area, and a plurality of both offensive and defensive implements, where the defensive blocking implements are thrown by an opposing defensive player during regular play, i.e., not turn-based like the traditional rules of cornhole, described supra. Areskog et al. do not disclose a plurality of multiple target areas, nor a plurality of offensive targets and defensive targets.

In a further example, U.S. Pat. No. 7,775,525 (hereinafter "Staver et al.") disclosed a tossing game, a method of manufacture and a method of use. The target of Staver et al. substantially resembles a typical cornhole-type target, with a sloped top surface, but is alternatively configured with multiple apertures arranged as scoring targets. The surface also includes printed indicia associated with scores achieved by tossing the game piece into specific apertures. The invention disclosed in Staver et al. is sports-based and includes different templates to simulate football, baseball, soccer, basketball and auto-racing, for example. The templates cover the top of the target exposing the apertures. Staver et al. do not disclose playing a team-based game using multiple targets: offense and defense.

Thus, there is a long felt need for a game piece tossing game which includes a plurality of scoring targets and a plurality of defensive targets, where a first team may arrange each of the plurality of scoring targets at a particular distance from a starting line, and where a neutral party may arrange each of the defensive targets substantially adjacent, or at least proximate to, at least one of the plurality of scoring targets.

There is also a long felt need for a game piece tossing game which includes a plurality of scoring targets and a plurality of defensive targets, where a first team may arrange each of the plurality of scoring targets at a particular distance from a starting line, and where a second team may arrange each of the defensive targets substantially adjacent, or at least proximate to, at least one of the plurality of scoring targets.

There is a further long felt need for a game piece tossing game which includes a plurality of scoring targets and a plurality of defensive targets, where a first team may arrange each of the plurality of scoring targets at a particular distance from a starting line, and where a neutral party or a second team may arrange each of the defensive targets substantially adjacent, or at least proximate to, at least one of the plurality of scoring targets, where there are a greater number of defensive targets than scoring targets.

SUMMARY

The present invention generally comprises a game piece tossing game having a first plurality of offensive game targets, where each of the offensive targets comprises a playing surface and a target aperture within the playing surface, a second plurality of defensive game targets, where each of the defensive targets comprises a playing surface and a target aperture within the playing surface, at least one game piece, arranged to be tossed toward the playing surface of at least one of the offensive game targets, and preferably arranged to be tossed toward the target aperture within the playing surface of the at least one of the offensive game targets, wherein the first plurality of offensive game targets are arranged on a playing field by a first team, and the second plurality of defensive game targets are arranged on a playing field by a neutral party or by a second team. In some configurations, the second plurality of defensive game targets of the game piece tossing game is greater than the first plurality of offensive game targets.

The present invention also comprises a method for playing a game piece tossing game, the method comprising the steps of: (1) assigning at least one player to a first team; (2) assigning at least one player to a second team; (3) placing a plurality of offensive targets into a plurality of positions on a playing field relative to a starting line on the playing field, each of the plurality of offensive targets having a target aperture and a target surface; (4) placing a plurality of defensive targets into a plurality of positions on the playing field, each of the plurality of defensive targets having a target aperture and a target surface, where the plurality of defensive targets is greater than the plurality of offensive targets; (5) determining which of the first team and the second team is a first throwing team and a second throwing team; (6) throwing at least one game piece from the starting line by the first throwing team toward the plurality of offensive targets and the plurality of defensive targets, preferably towards the plurality of offensive targets; (7) calculating a score of the first throwing team based on which of the plurality of offensive targets and the defensive targets the at least one game piece is thrown through or on; (8) throwing at least one game piece from the starting line by the second throwing team toward the plurality of offensive targets and the plurality of defensive targets, preferably towards the plurality of offensive targets; (9) calculating a score of the second throwing team based on which of the plurality of offensive targets and the defensive targets the at least one game piece is thrown through or on; (10) repeating steps (6) through (9) at least once; (11) adding the scores of step (7) to determine a total score of the first throwing team and adding the scores of step (9) to determine a total score of the second throwing team; and, (12) comparing the total score of the first throwing team and the total score of the second throwing team to determine a winner.

In other embodiments, the present invention may also comprise a method for playing a game piece tossing game, the method comprising the steps of: (1) placing a plurality of offensive targets into a plurality of positions on a playing field relative to a starting line on the playing field, each of the plurality of offensive targets having a target aperture and a target surface; (2) placing a plurality of defensive targets into a plurality of positions on the playing field, each of said plurality of defensive targets having a target aperture and a target surface, the plurality of defensive targets is greater than the plurality of offensive targets; (3) throwing at least one game piece from the starting line toward the plurality of offensive targets and the plurality of defensive targets, preferably towards the plurality of offensive targets; and, (4) calculating a score based on which of the plurality of offensive targets and the defensive targets the at least one game piece is thrown to.

In further embodiments, the present invention may also comprise a method of scoring in a game piece tossing game, the method comprising the steps of: earning a first predetermined score when successfully tossing a game piece onto a surface of an offensive target; earning a second predetermined score when successfully tossing a game piece into an aperture on the surface of the offensive target; and, earning a first negative score when tossing a game piece onto a surface of a defensive target.

In other configurations, the present invention may also comprise a game piece tossing game, the game piece tossing game comprising at least one offensive game target having a playing surface and an offensive target aperture within the playing surface, the playing surface including printed indicia thereon, the printed indicia comprising a graphical representation of the upper body of a first football player including an open-hand configuration arranged to at least partially circumscribe the offensive target aperture, the configuration functioning to indicate the offensive target aperture.

In further configurations, the present invention may also comprise a game piece tossing game, the game piece tossing game comprising at least one defensive game target having a playing surface and a defensive target aperture within the playing surface, the playing surface including printed indicia thereon, the printed indicia comprising a graphical representation of the upper body of a second football player including an open-hand configuration arranged to at least partially circumscribe the defensive target aperture, the configuration functioning to indicate the defensive target aperture.

These and other objects, features, and advantages of the present invention will become readily apparent upon a review of the following detailed description, in view of the drawings and appended claims.

BRIEF DESCRIPTION OF THE DRAWINGS

Various embodiments are disclosed, by way of example only, with reference to the accompanying schematic drawings, in which corresponding reference symbols indicate corresponding parts, in which:

FIG. 1B generally illustrates a bottom perspective view of the game target shown in

FIG. 1A;

DETAILED DESCRIPTION

Figure 1A:
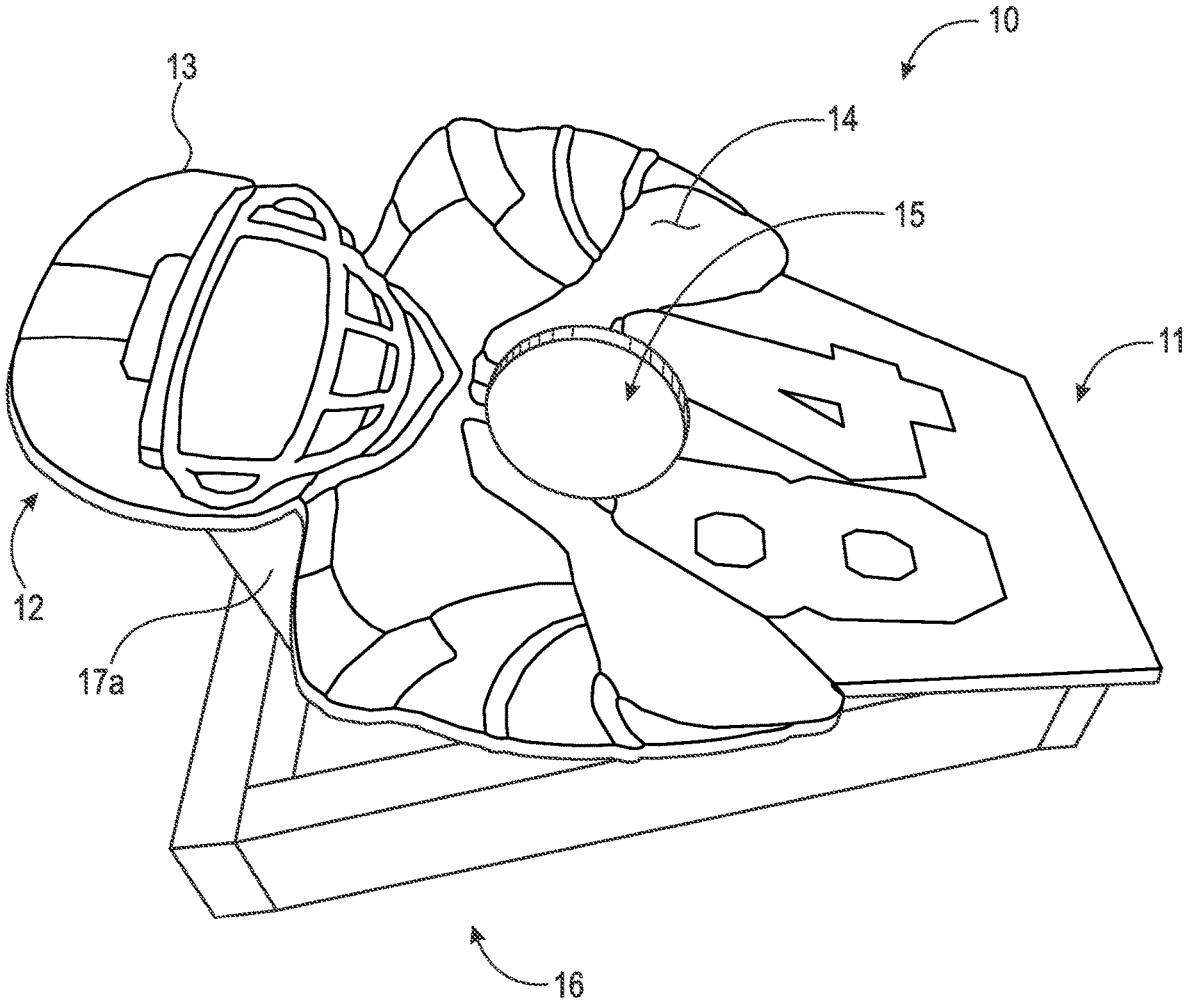
FIG. 1A generally illustrates a top perspective view of a game target of the present invention.
Figure 1B:
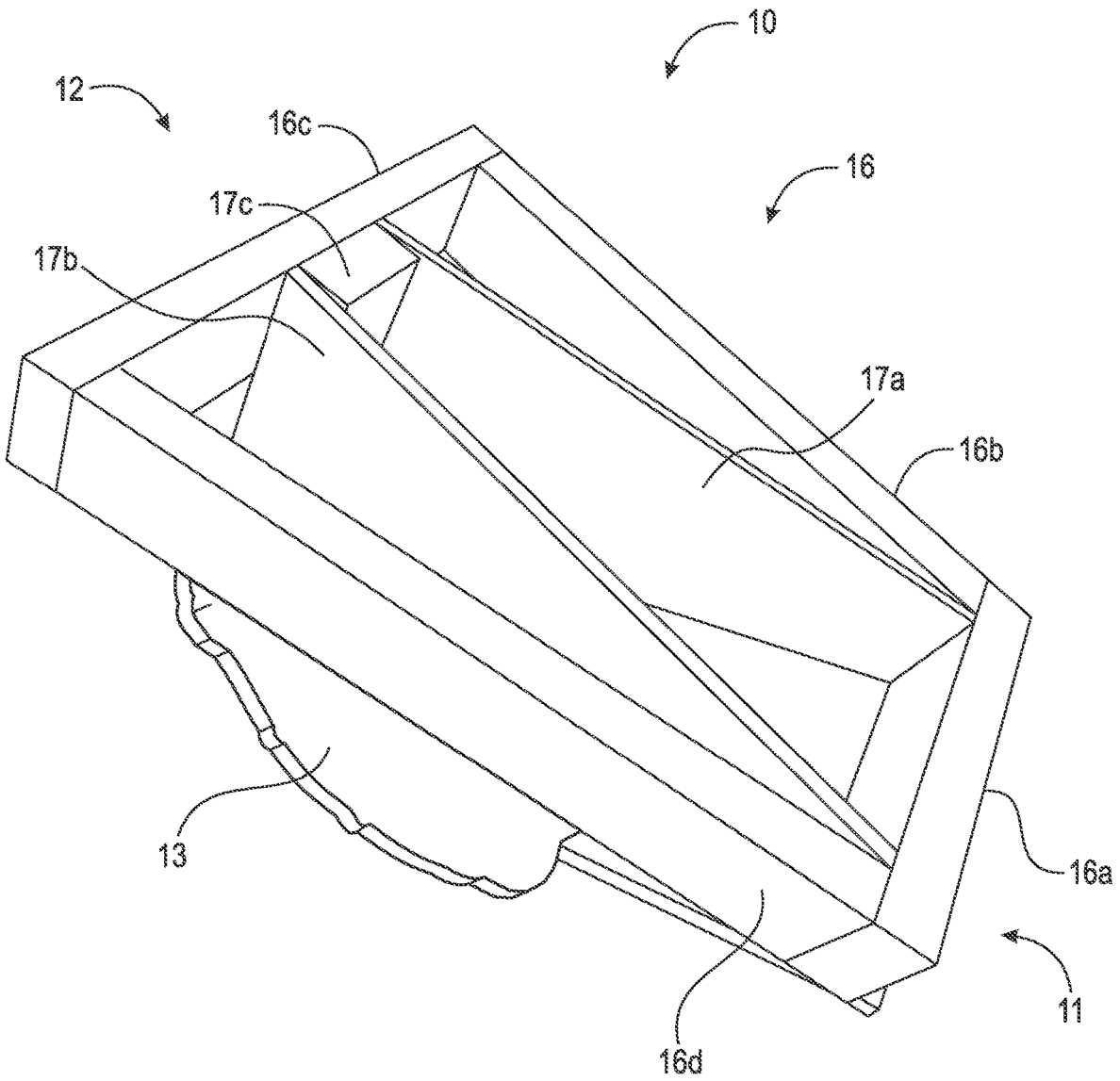

At the outset, it should be appreciated that like drawing numbers on different drawing views identify identical, or functionally similar, structural elements. It is to be understood that the claims are not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the claims.

Unless defined otherwise, all technical and scientific terms used herein have the same meaning as commonly understood to one of ordinary skill in the art to which this disclosure pertains. It should be understood that any methods, devices or materials similar or equivalent to those described herein can be used in the practice or testing of the example embodiments.

It should be appreciated that the term "substantially" is synonymous with terms such as "nearly," "very nearly," "about," "approximately," "around," "bordering on," "close to," "essentially," "in the neighborhood of," "in the vicinity of," etc., and such terms may be used interchangeably as appearing in the specification and claims. It should be appreciated that the term "proximate" is synonymous with terms such as "nearby," "close," "adjacent," "neighboring," "immediate," "adjoining," etc., and such terms may be used interchangeably as appearing in the specification and claims. The term "approximately" is intended to mean values within ten percent of the specified value.

It should be understood that use of "or" in the present application is with respect to a "non-exclusive" arrangement, unless stated otherwise. For example, when saying that "item x is A or B," it is understood that this can mean one of the following: (1) item x is only one or the other of A and B; (2) item x is both A and B. Alternately stated, the word "or" is not used to define an "exclusive or" arrangement. For example, an "exclusive or" arrangement for the statement "item x is A or B" would require that x can be only one of A and B. Furthermore, as used herein, "and/or" is intended to mean a grammatical conjunction used to indicate that one or more of the elements or conditions recited may be included or occur. For example, a device comprising a first element, a second element and/or a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element.

Moreover, as used herein, the phrases "comprises at least one of" and "comprising at least one of" in combination with a system or element is intended to mean that the system or element includes one or more of the elements listed after the phrase. For example, a device comprising at least one of: a first element; a second element; and, a third element, is intended to be construed as any one of the following structural arrangements: a device comprising a first element; a device comprising a second element; a device comprising a third element; a device comprising a first element and a second element; a device comprising a first element and a third element; a device comprising a first element, a second element and a third element; or, a device comprising a second element and a third element. A similar interpretation is intended when the phrase "used in at least one of:" is used herein. A similar interpretation is intended when used in a method of using the present invention.

It will be appreciated that various aspects of the disclosure above and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

Game Piece Tossing Game

The following description should be taken in view of FIGS. 1A through 3D, which generally illustrate a top perspective view of a game target of the present invention, a bottom perspective view, a top plan view, a bottom plan view, a left elevational view, a right elevational view, a front elevational view, and a rear elevational view of the same. The present invention generally comprises game piece tossing game 100, shown in FIG. 5, infra. The game piece tossing game includes a plurality of targets, where each of the plurality of targets is generally designated by reference numeral 10 (and its equivalents 10*a* through 10*c*) and/or reference numeral 20 (and its equivalents 20*a* through 20*g*).

Target 10 includes first end 11 and second end 12. Target 10 generally comprises target board 13 having playing surface 14, mounting surface 14*a*, and target aperture 15, base 16, and a plurality of risers, 17*a* through 17*c*, extending from base 16.

In some embodiments, base 16 is formed by a plurality of members, 16*a* through 16*d*, which are preferably fixed secured to one another to form base 16. It should be appreciated that base 16 could comprise a singular piece. Members 16*a* and 16*d*, when interconnected form internal space 16*e*.

Riser 17*a*, riser 17*b*, and medial riser 17*c* extend from base 16. In a preferred embodiment, riser 17*a* is secured to an inside surface of members 16*a* and 16*c*, riser 17*b* is secured to an inside surface of members 16*a* and 16*c*, and medial riser 17*c* is secured to an inside surface of member 16*c* and is arranged between risers 17*a* and 17*b*. Risers 17*a* and 17*b* have a tapered configuration on their surfaces arranged away from base 16, specifically a taper that slopes substantially downward from second 12 to first end 11 of target 10. Medial riser 17*c* may also have the aforementioned taper. Member 16*a* of base 16 may also have the aforementioned taper, i.e., the inside surface of member 16*a* tapers downwardly in the direction towards the outside surface of member 16*a*.

Mounting surface 14*a* of target board 13 is arranged to be secured to a top end of risers 17*a* through 17*c*, i.e., the end of risers 17*a* through 17*c* that substantially extends to, or past, the topmost edge of base 16. Due to the tapered configuration of 17*a* through 17*c*, and/or member 16*a*, target board 13, when secured thereon, will have a substantially downward slope from second end 12 to first end 11. In a preferred embodiment, angle α is the angle of target surface 14 and the lowermost surface of base 16, where angle α is preferably an acute angle. In some embodiments, angle α is less than 45°. In other embodiments, angle α may be between 100-35°. It should be appreciated that angle α may be arranged to a plurality of different degrees depending on the desired slope of target surface 14 of target board 13.

In a preferred embodiment, the edges of target board 13, proximate first end 11 and second end 12, are arranged to extend past members 16*a* and 16*c*. In some configurations, portions of the edges of target board 13, proximate members 16*b* and 16*d*, are arranged to extend past members 16*b* and 16*d*.

In a preferred embodiment, target board 13 is configured to substantially resemble the upper torso of a football player, that is, a football player having a helmet and shoulder pads underneath a jersey, where target board may also include various markings that further illustrate a football player, e.g., jersey numbers, jersey decals, helmet styles and/or decals, etc.

Figure 4:
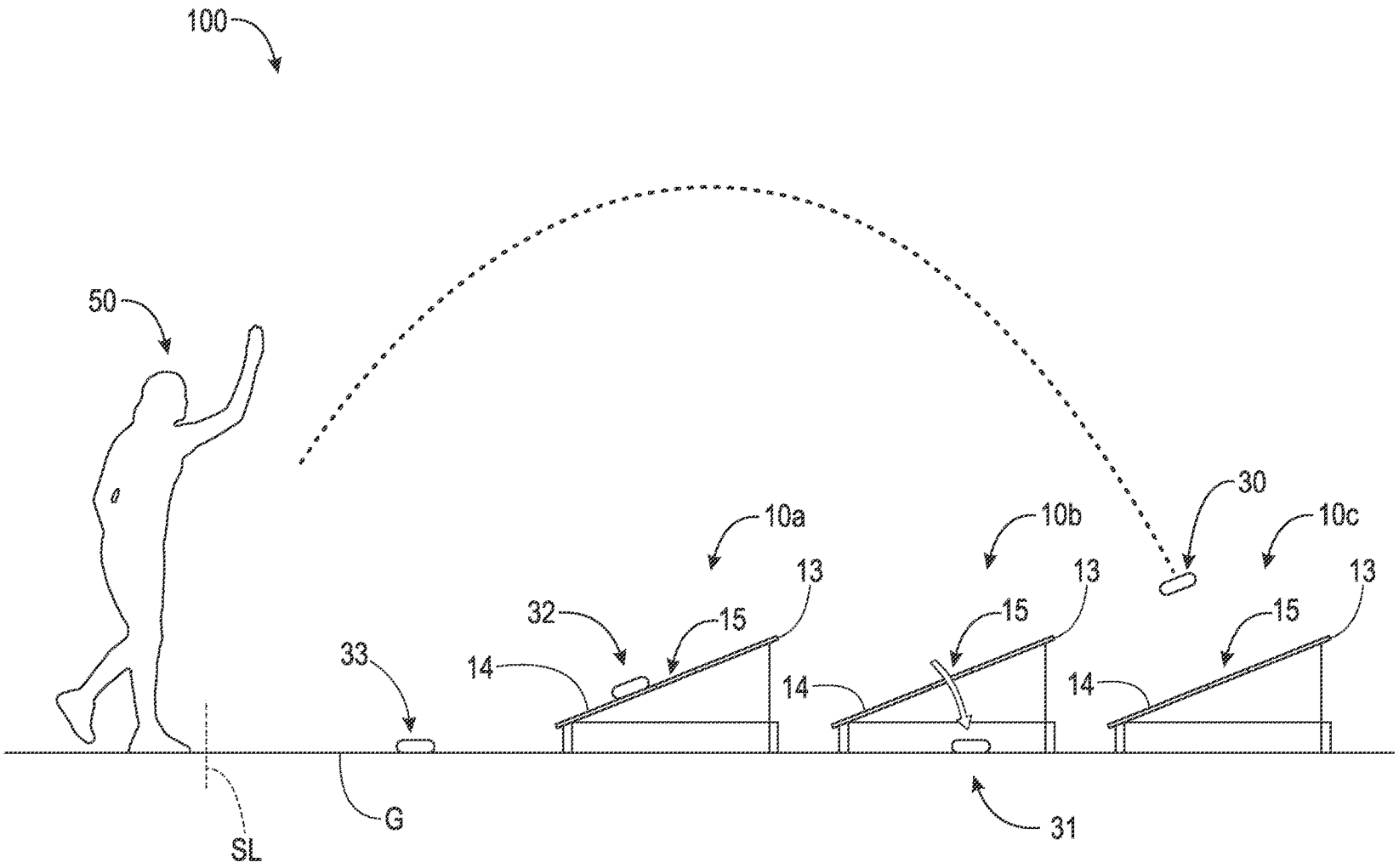
FIG. 4 generally illustrates the present invention in use.

Adverting now to FIG. 4 which generally shows game piece tossing game 100 in use. The following description should also be taken in view of the aforementioned figures. In an embodiment of piece tossing game 100, three targets, 10*a*, 10*b*, 10*c*, are positioned on ground G at various distances from starting line SL. Player 50 stands behind starting line SL and throws game pieces 32, 31, 30, and 33 at targets 10*a*, 10*b*, and 10*c*, respectively. Game piece 32 is illustrated atop target board 13 (on playing surface 14) of target 10*a*, Game piece 31 is illustrated as thrown-through target aperture 15 of target 10*b* and is resting on ground G, game piece 33 is illustrated resting on ground G, and game piece 30 is illustrated in mid-air after player 50 threw game piece 30 attempting to throw game piece 30 through target aperture 15 of target 10*c*.

In some arrangements of game piece tossing game 100, landing a game piece on a playing surface, i.e., game piece 32 on playing surface 14 of target 10*a*, may be considered a miss, that is, no points are awarded. In other arrangements of game piece tossing game 100, landing a game piece on a playing surface, i.e., game piece 32 on playing surface 14 of target 10*a*, may be considered a score, that is, points are awarded. In further arrangements of game piece tossing game 100, throwing the game piece through a target aperture, i.e., game piece 31 being thrown through target aperture 15 of target 10*b*, may be considered a score, that is points are awarded. In even further arrangements of game piece tossing game 100, throwing the game piece onto the ground, i.e., game piece 33 on ground G, may be considered a miss, that is, no points are awarded.

In a preferred embodiment game pieces 30 through 33 may be comprised of a "bean bag" that complies with, or is substantially similar to, the bean bags required by the American Cornhole League. Thus, these bean bags are double-seamed fabric bags measuring approximately six by six inches and weighing approximately 14.5 to 17.5 ounces. The bags may be filled with preserved corn kernels, dried beans, plastic resin or other materials, such that the bags will maintain a consistent weight and shape over many throws without deforming. As such, the aforementioned description of the game pieces of the present invention is intended to be exemplary and non-restrictive as alternatives are intended to be within the scope of the appending claims.

It should be appreciated that the aforementioned game pieces could take a variety of forms. For example, the game pieces could be balls, e.g., tennis balls, or could take the form of flying discs, or could take the form of a football-shaped game piece, or could similarly comprise a puck, ring, horseshoe, and/or dart (i.e., lawn dart, tipped, or not tipped).

Figure 5:
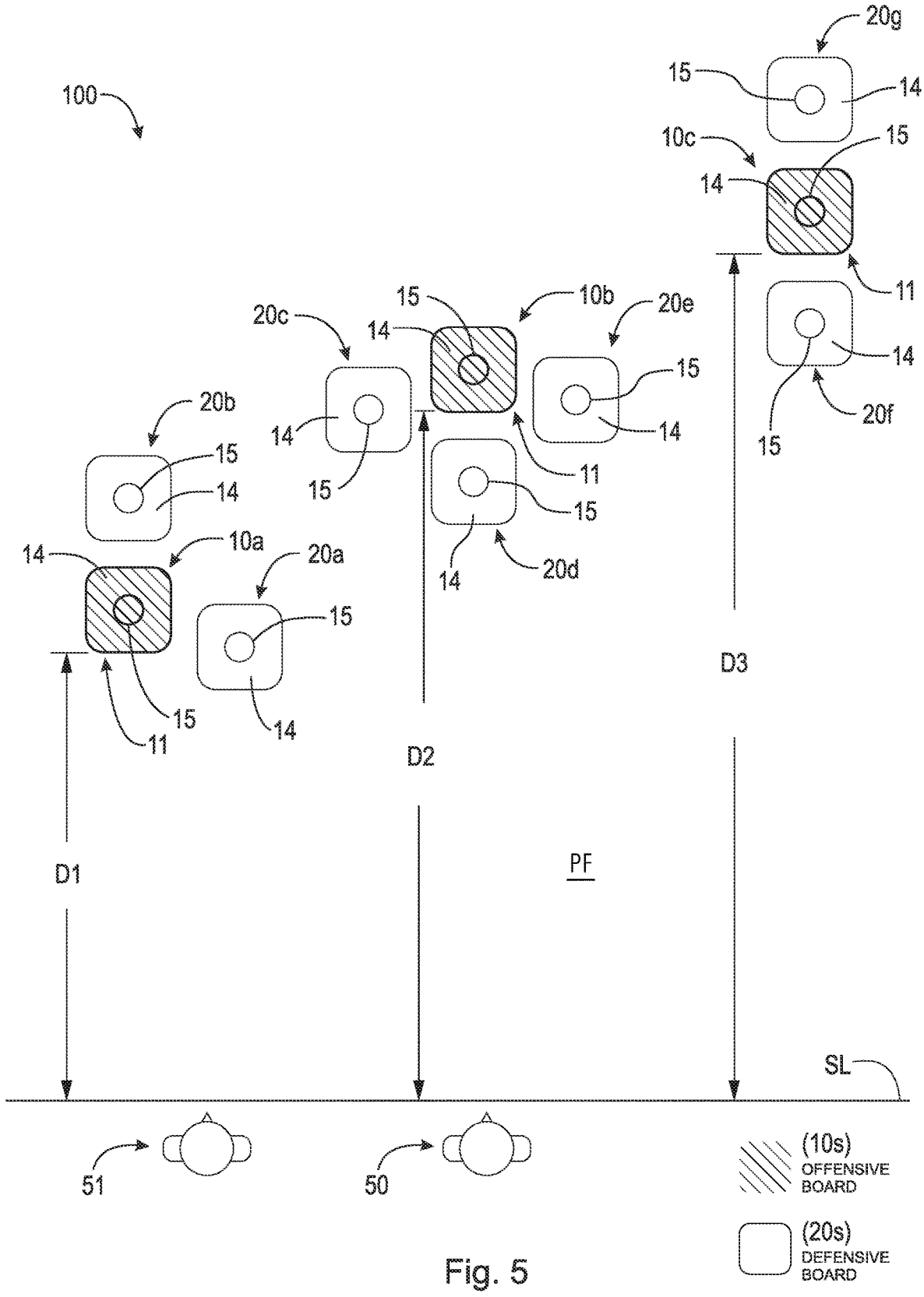
FIG. 5 generally illustrates a top plan view of an arrangement of the present invention in use.

It should be appreciated that the positions of game pieces 31 and 32 could also apply to targets 20*a*, 20*b*, 20*c*, 20*d*, 20*e*, 20*f*, and/or 20*g* illustrated in FIG. 5, infra.

The following description should be taken in view of FIG. 5 and the aforementioned figures. FIG. 5 generally illustrates an example of game piece tossing game 100 having offensive targets (10*a*, 10*b* and 10*c*) and defensive targets (20*a*, 20*b*, 20*c*, 20*d*, 20*e*, 20*f*, and 20*g*). It should be appreciated that targets 10*a*, 10*b*, 10*c*, 20*a*, 20*b*, 20*c*, 20*d*, 20*e*, 20*f*, and 20*g* all include the aforementioned components of target 10, e.g., playing surface 14, target aperture 15, etc. Players 50 and 51 are shown behind starting line SL. In some embodiments, player 50 is an offensive player, i.e., a team throwing a game piece as generally illustrated in FIG. 4. When the team of player 50 is on offense, player 50 will position the offensive targets (10*a*, 10*b* and 10*c*) are various distances from starting line SL (D1, D2, and D3). After the offensive targets are positioned, player 51, who is a defensive player, i.e., a team who is "defending" against the offensive team, will position the defensive targets (20*a*, 20*b*, 20*c*, 20*d*, 20*e*, 20*f*, and 20*g*) in various positions proximate the offensive targets (10*a*, 10*b* and 10*c*). In the arrangement shown in FIG. 5, targets 20*a* and 20*b* are positioned proximate target 10*a*, targets 20*c*, 20*d*, and 20*e* are positioned proximate target 10*b*, and targets 20*f* and 20*d* are positioned proximate target 10*c*.

Once player 50 has thrown all of the game pieces, e.g., three, four, five, etc. game pieces, at the offensive targets, a score is calculated based on the locations of each game piece, i.e., the various positions of game pieces 30 through 33, illustrated in FIG. 4, on or through the various offensive and/or defensive targets, or on the ground. After the score is calculated, the teams switch, i.e., player 50 and their respective team are on defense and control the defensive targets and player 51 and their respective team are on offense and control the offensive targets.

If player 50, the offensive team, throws one of the game pieces through a target aperture of a defensive target, i.e., target aperture 15 of target 20*c*, that is considered an interception, and the aforementioned team switch occurs, i.e., the offensive team switches to defense and the defensive team switches to offense, regardless of how many game pieces are left to be thrown by the offensive team.

Figure 2B:
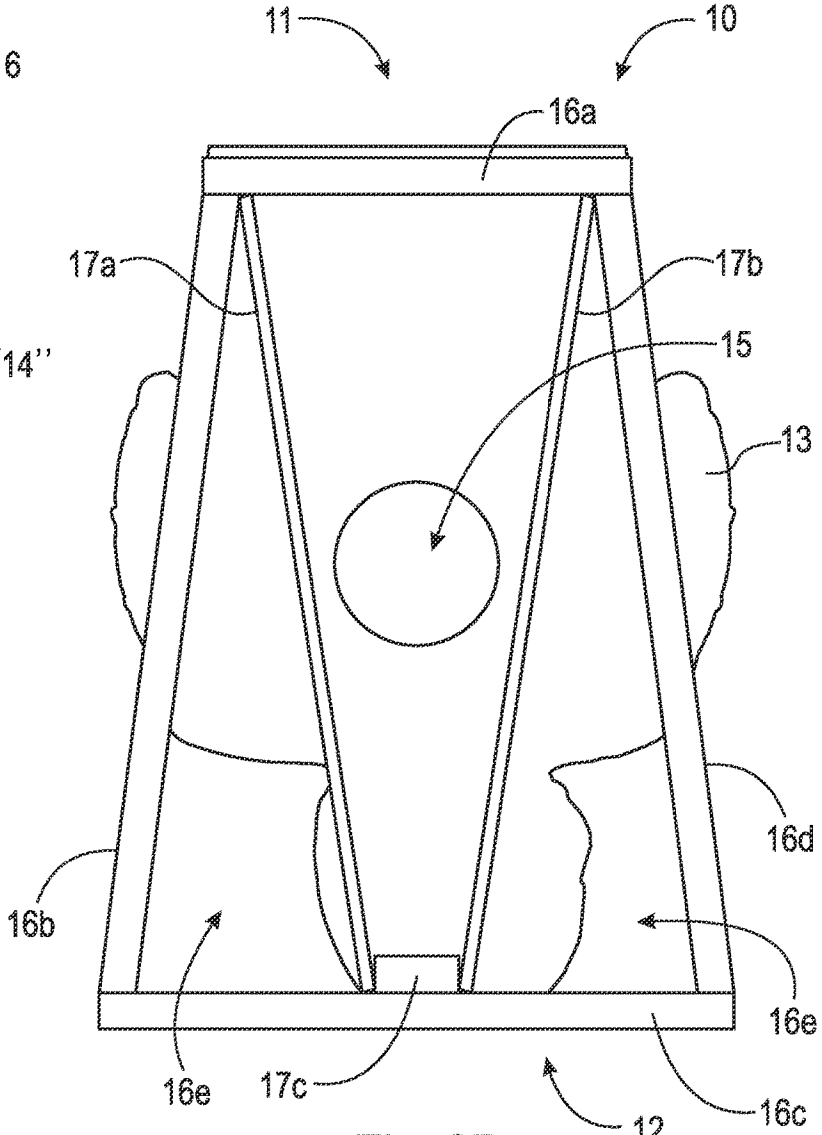
FIG. 2B generally illustrates a bottom plan view of the game target shown in FIG. 1A.
Figure 2A:
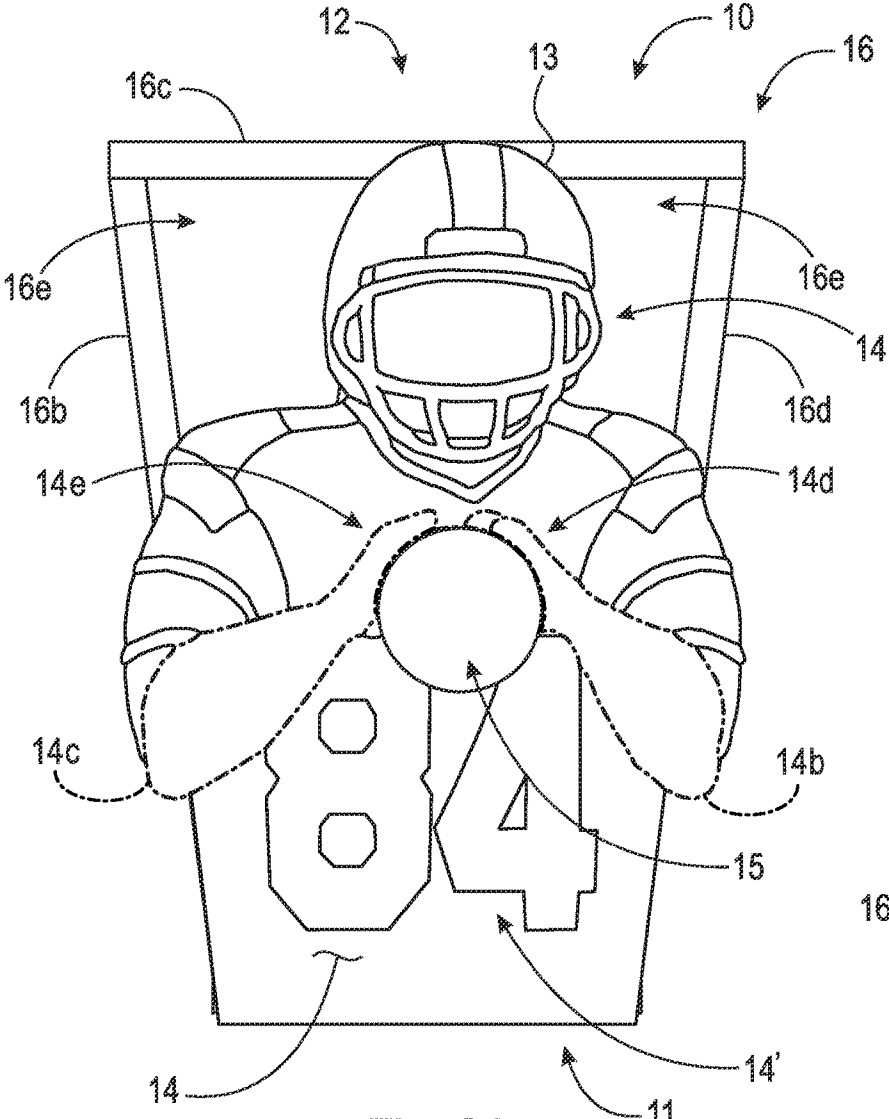
FIG. 2A generally illustrates a top plan view of the game target shown in FIG. 1A.
Figure 3A:
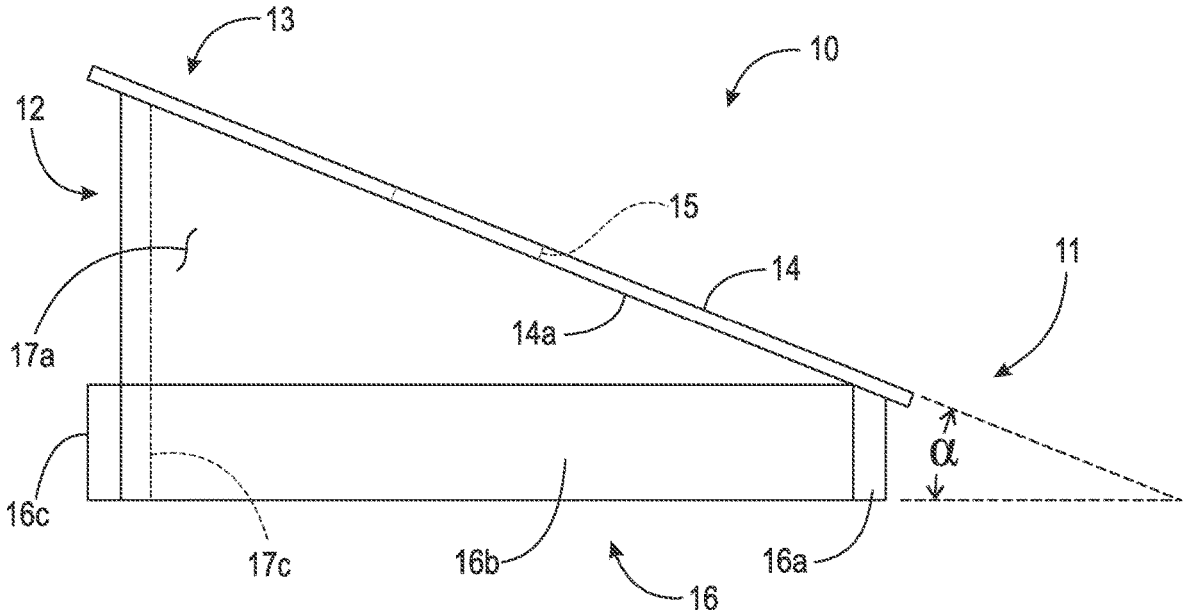
FIG. 3A generally illustrates a left elevational view of the game target shown in FIG. 1A.
Figure 3B:
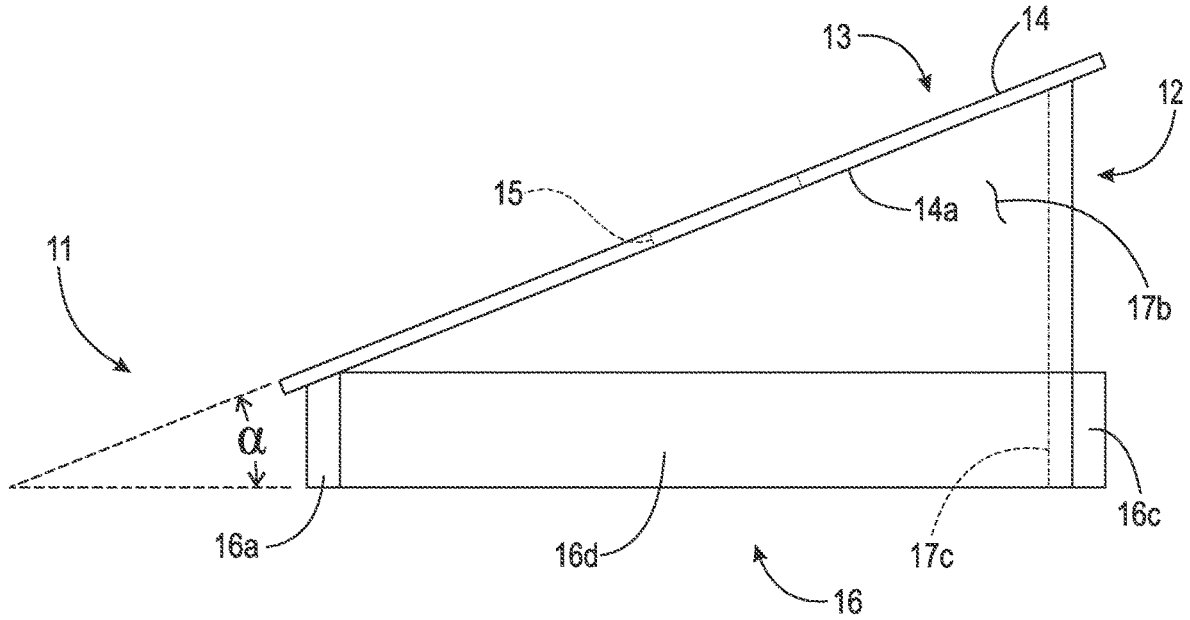
FIG. 3B generally illustrates a right elevational view of the game target shown in FIG. 1A.
Figure 3C:
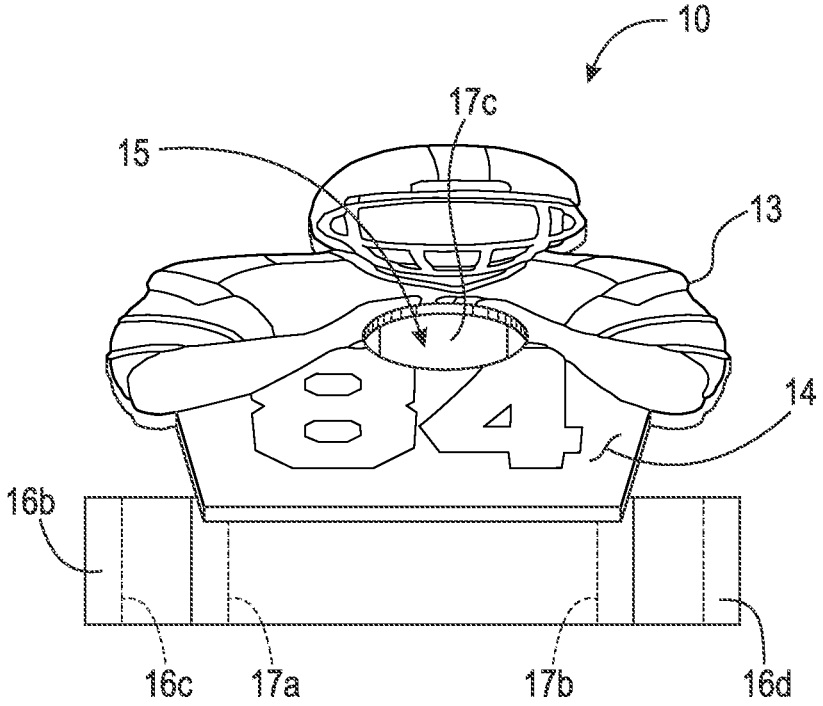
FIG. 3C generally illustrates a front elevational view of the game target shown in FIG. 1A.
Figure 3D:
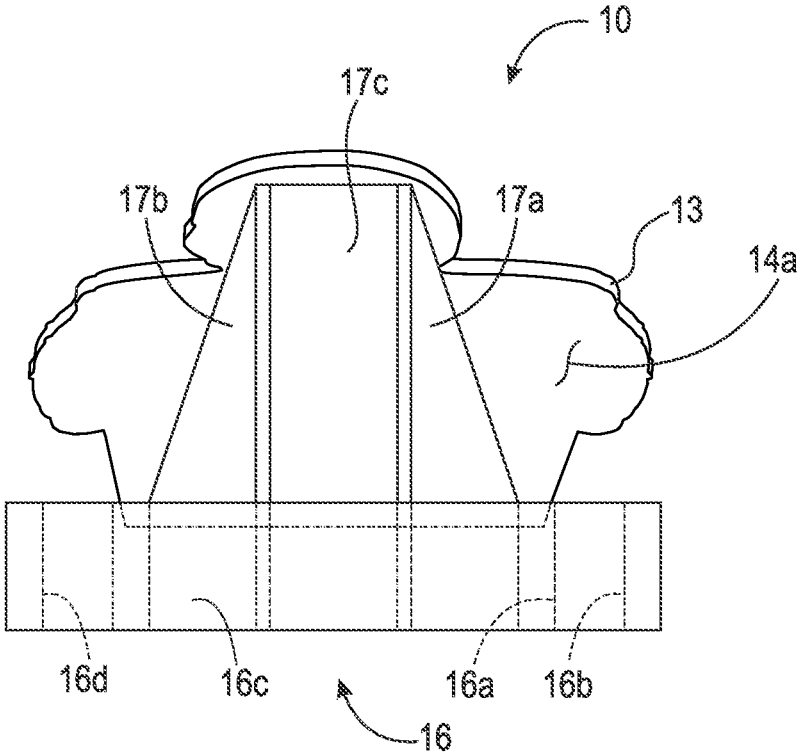
FIG. 3D generally illustrates a rear elevational view of the game target shown in FIG. 1A.

The following description specifically pertains to FIG. 2A and should also be taken in view of the aforementioned figures and respective descriptions. In a preferred embodiment, target board 13 is configured with the appearance of an upper torso of a football player, i.e., a playing wearing a helmet, a jersey fit over shoulder pads, and where the jersey has a number and a design. Specifically, the aforementioned appearance is arranged on playing surface 14 having jersey indicia configuration 14' and helmet indicia configuration 14", where jersey indicia configuration 14' preferably displays numbers and/or logos. It should be appreciated that helmet indicia configuration 14" could also preferably display numbers and/or logos. The aforementioned appearance arranged on playing surface 14 also includes first arm indicia 14*b* and second arm indicia 14*c*. First hand indicia portion 14*d* is located on first arm indicia 14*b*, proximate target aperture 15. Second hand indicia portion 14*e* is located on second arm indicia 14*c*, proximate target aperture 15. First hand indicia portion 14*d* and second hand indicia portion 14*e* designate where a respective game piece should be shown-similar to the concept of a football player throwing a football to "the hands of a wide receiver".

It should be appreciated that the aforementioned indicia configurations can be applied to offensive and/or defensive targets, whereas jersey indicia configuration 14' and helmet indicia configuration 14" of an offensive target may have a first design, logo, and/or color, and jersey indicia configuration 14' and helmet indicia configuration 14" of a defensive target may have a second design, logo, and/or color-indicating to a player playing the game which target they should throw too, preferably offensive, and which target they should avoid throwing too, preferably defensive (generally depicted in FIG. 5). In other words, jersey indicia configuration 14' and helmet indicia configuration 14" of an offensive target indicates that playing surface 14 of the offensive target scores points (offensive playing surface $\mathbf{14}_O$, generally depicted in FIG. 7B), and inversely, jersey indicia configuration 14' and helmet indicia configuration 14" of a defensive target indicates that playing surface 14 of the defensive target deducts points (defensive playing surface $\mathbf{14}_D$, generally depicted in FIG. 7E).

Figure 7A:
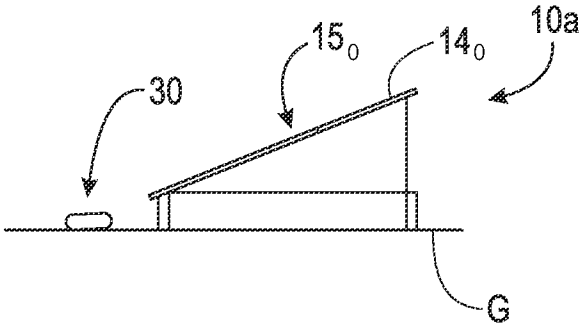
FIGS. 7A through 7F generally illustrate various scoring situations of a game played with the present invention.
Figure 7B:
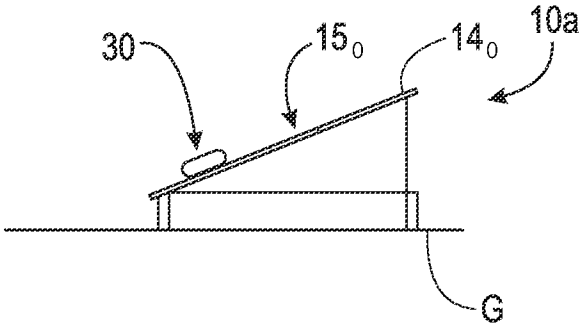
Figure 7C:
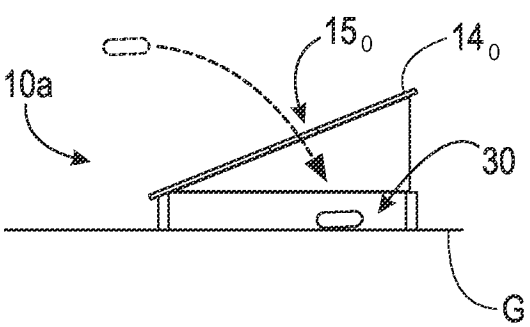
Figure 7D:
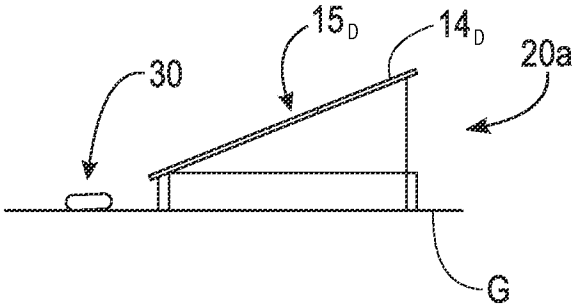
Figure 7E:
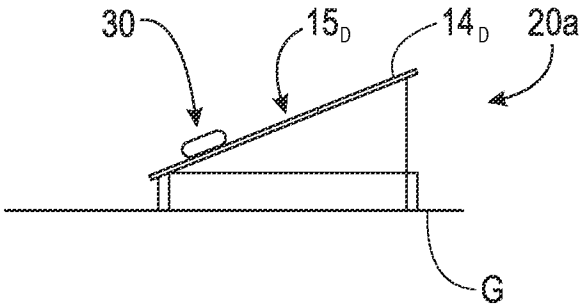
Figure 7F:
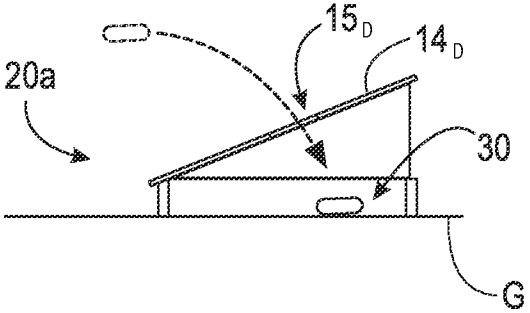

It should be further appreciated that aforementioned indicia configurations can be applied to offensive and/or defensive targets, whereas first hand indicia portion 14*d* (located on first arm indicia 14*b*) and second hand indicia portion 14*e* (located on second arm indicia 14*c*) of an offensive target will indicate target aperture 15 that scores points (offensive target aperture $\mathbf{15}_O$, generally depicted in FIG. 7C) and inversely, where first hand indicia portion 14*d* (located on first arm indicia 14*b*) and second hand indicia portion 14*e* (located on second arm indicia 14*c*) of a defensive target will indicate target aperture 15 that deducts points (defensive target aperture $\mathbf{15}_D$, generally depicted in FIG. 7F).

The aforementioned points, either scored or deducted, is explained in greater detail, infra.

It should be noted that the number of offensive targets and defensive targets can vary, however, in a preferred embodiment of use, there will be a greater number of defensive targets positioned in play than offensive targets positioned in play.

Preferred Game Rules and Corresponding Method of Play

Figure 6:
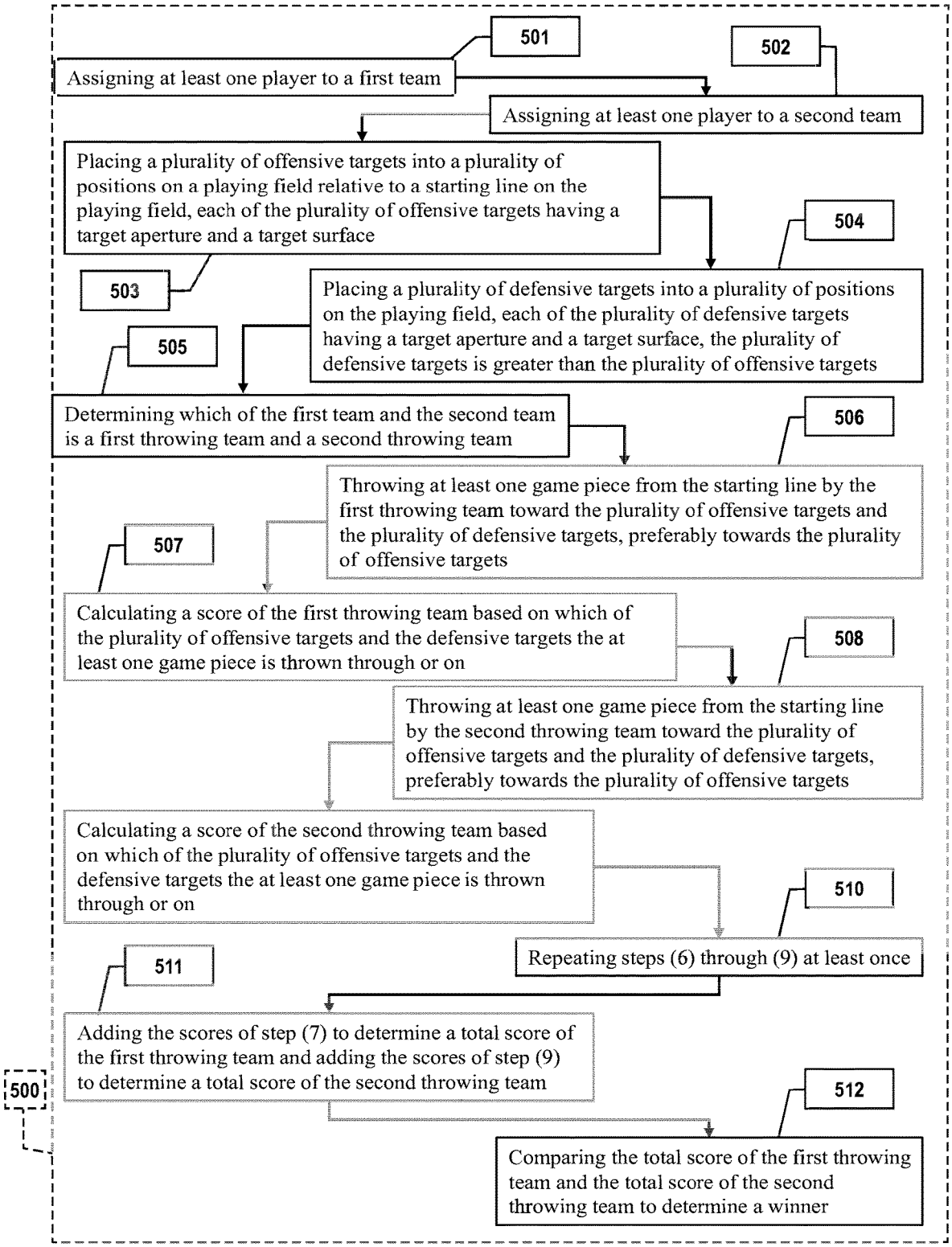
FIG. 6 generally illustrates a method of use of the present invention.

The following description should be taken in view of all of the aforementioned figures and FIG. 6, where FIG. 6 generally illustrates a method of play of the present invention.

In a preferred embodiment, game piece tossing game 100 includes three (3) offensive targets (10*a* through 10*c*) and four (4) defensive targets (20*a* through 20*d*) however it should be noted that the number of offensive and defensive targets may vary. In other words, there needs to be at least one more of the total defensive target than total offensive targets.

It should be noted that the terms "target" and "board" are substantially equivalent.

In some embodiments, offensive targets (10*a* through 10*c*) have preferred distances for placement on playing field PF relative to starting line SL. For example, distance D1 that corresponds to target 10*a* is preferably positioned approximately 18' from starting line SL, distance D2 that corresponds to target 10*b* is preferably positioned approximately 25' from starting line SL, and distance D3 that corresponds to target 10*c* is preferably positioned approximately 31' and 6" from starting line SL. The distances D1 through D3 may be taken from the starting line SL and one of either a center point of target aperture 15 of a target, or the edge of member 16*a* of a respective target (or a similar edge of a target that is proximate starting line SL).

The target that is positioned at distance D1 may also be referred to as the "short" target. The target that is positioned at distance D2 may also be referred to as the "medium" target. The target that is positioned at distance D3 may also be referred to as the "deep" or "long" target. In a preferred use of game piece tossing game 100, the target aperture and the playing surface of the short target (i.e., aperture 15 and playing surface 14 of target 10*a*) are worth 1-point and 3-points respectively, the target aperture and the playing surface of the medium target (i.e., aperture 15 and playing surface 14 of target 10*b*) are worth 2-points and 5-points respectively, and the target aperture and the playing surface of the long target (i.e., aperture 15 and playing surface 14 of target 10*c*) are worth 3-points and 7-points respectively points are awarded by throwing the game piece on the playing surface or throwing the game piece through the target aperture, generally illustrated in FIG. 4.

Before the game pieces are thrown, the defensive targets are positioned (20*a*, 20*b*, 20*c*, 20*d*, 20*e*, 20*f*, and 20*g*) on playing field PF such that each respective defensive target is preferably proximate an offensive target (10*a* through 10*c*). A defensive target that is positioned proximate distance D1 may also be referred to as the "short" defensive target. A defensive target that is positioned proximate distance D2 may also be referred to as the "medium" defensive target. A defensive target that is positioned proximate distance D3 may also be referred to as the "deep" or "long" defensive target. In a preferred use of game piece tossing game 100, the target aperture and the playing surface of the short defensive target, or targets (i.e., apertures 15 and playing surfaces 14 of targets 20*a* and 20*b*) are worth −1 point and −3 points respectively, the target aperture and the playing surface of the medium defensive target, or targets (i.e., apertures 15 and playing surfaces 14 of targets 20*c*, 20*d*, and 20*e*) are worth −2 points and −5 points respectively, and the target aperture and the playing surface of the long defensive target, or targets (i.e., apertures 15 and playing surfaces 14 of targets 20*g* and 20*f*) are worth −3 points and −7 points respectively points are awarded by throwing the game piece on the playing surface or throwing the game piece through the target aperture, generally illustrated in FIG. 4. If game pieces are thrown through a target aperture of any of the defensive targets, the negative points are awarded to the throwing (offensive team) and the throwing team also ends their turn. The defensive team becomes the throwing team, and the throwing team becomes the defensive team. This is called an "interception".

Generally, defensive targets can be arranged anywhere on the playing field so long as there is approximately a 4" distance between any offensive target and any defensive target. In some embodiments, the position of each defensive target is determined by a neutral party, i.e., a referee, where in other embodiments, the position of each defensive target is determined by the defensive team, i.e., the team who does not throw the game pieces first.

In a preferred use, the game involving game piece tossing game 100 has at least two players, where one of the two players is on a first team and the other of the two players is on a second team. The teams will determine which team will throw the game pieces first, i.e., be the first offensive team, whereas the other team will throw the game pieces second, i.e., be the first defensive team. The determination can be decided with a coin toss, general discussion, etc.

Once the targets are in position for play, as described supra, the first offensive team may begin their "turn". In a preferred arrangement, there are four (4) game pieces. A full "turn" is completed when each player of a team throws all four (4) game pieces, e.g., a team of three (3) players will each throw four (4) game pieces, totaling twelve (12) throws per turn. Each team will have four (4) turns during a full game, where a turn for each team is one quarter of the game, i.e., a full game has four (4) quarters. Turns are ended prematurely for a team if any member of the team throws an interception (i.e., a game piece is thrown into the target aperture of a defensive target), as described supra. At the end of two (2) quarters, i.e., halftime, the team with the lowest score may rearrange the targets in accordance with the aforementioned positioning guidelines. At the end of the four (4) quarters, if both teams have the score, i.e., tie, then one additional quarter, i.e., an additional turn for each team, is played to determine the winner.

As shown in FIG. 6, the present invention may also comprise method for playing a game piece tossing game 500. Method 500 comprises the steps of: (1) assigning at least one player to a first team (501); (2) assigning at least one player to a second team (502); (3) placing a plurality of offensive targets into a plurality of positions on a playing field relative to a starting line on the playing field, each of the plurality of offensive targets having a target aperture and a target surface (503); (4) placing a plurality of defensive targets into a plurality of positions on the playing field, each of the plurality of defensive targets having a target aperture and a target surface, the plurality of defensive targets is greater than the plurality of offensive targets (504); (5) determining which of the first team and the second team is a first throwing team and a second throwing team (505); (6) throwing at least one game piece from the starting line by the first throwing team toward the plurality of offensive targets and the plurality of defensive targets, preferably towards the plurality of offensive targets (506); (7) calculating a score of the first throwing team based on which of the plurality of offensive targets and the defensive targets the at least one game piece is thrown through or on (507); (8) throwing at least one game piece from the starting line by the second throwing team toward the plurality of offensive targets and the plurality of defensive targets, preferably towards the plurality of offensive targets (508); (9) calculating a score of the second throwing team based on which of the plurality of offensive targets and the defensive targets the at least one game piece is thrown through or on (509); (10) repeating steps (6) through (9) at least once (510); (11) adding the scores of step (7) to determine a total score of the first throwing team and adding the scores of step (9) to determine a total score of the second throwing team (511); and, (12) comparing the total score of the first throwing team and the total score of the second throwing team to determine a winner (512).

Scoring

FIGS. 7A through 7F illustrate either the aforementioned offensive target or defensive target, further showing a game piece thrown at the target and the respective score associated with throwing the game piece. The following description should also be taken in view of FIG. 5.

FIG. 7A generally shows first target 10*a*, i.e., an offensive target, and game piece 30 on playing field PF after a player has thrown game piece 30. Game piece 30 is shown resting on PF, substantially in front of target 10*a*. This throw is worth zero points since game piece 30 did not land on offensive playing surface $\mathbf{14}_O$ or go through offensive target aperture $\mathbf{15}_O$ of the offensive target.

FIG. 7B generally shows first target 10*a*, i.e., an offensive target on playing field PF and game piece 30 after a player has thrown game piece 30. Game piece 30 is shown resting on offensive playing surface $\mathbf{14}_O$ of the offensive target. Depending on where the offensive target is positioned on game field, (i.e., D1, D2, or D3, as shown in FIG. 5) this throw is either worth 1, 2, or 3-points, respectively.

FIG. 7C generally shows first target 10*a*, i.e., an offensive target on playing field PF and game piece 30 after a player has thrown game piece 30. Game piece 30 is shown resting within the offensive target after it was thrown through offensive target aperture $\mathbf{15}_O$. Depending on where the offensive target is positioned on game field, (i.e., D1, D2, or D3, as shown in FIG. 5) this throw is either worth 3, 5, or 7-points, respectively.

FIG. 7D generally shows fourth target 20*a*, i.e., a defensive target, and game piece 30 on playing field PF after a player has thrown game piece 30. Game piece 30 is shown resting on PF, substantially in front of target 20*a*. This throw is worth zero points since game piece 30 did not land on defensive playing surface $\mathbf{14}_D$ or go through defensive target aperture $\mathbf{15}_D$ of the defensive target.

FIG. 7E generally shows fourth target 20*a*, i.e., a defensive target on playing field PF and game piece 30 after a player has thrown game piece 30. Game piece 30 is shown resting on defensive playing surface $\mathbf{14}_D$ of the defensive target. Depending on which offensive target the defensive target is positioned adjacent to, or proximate, on playing field PF, (i.e., D1, D2, or D3, as shown in FIG. 5) this throw is either worth −1, −2, or −3 points, respectively.

FIG. 7F generally shows fourth target 20*a*, i.e., a defensive target on playing field PF and game piece 30 after a player has thrown game piece 30. Game piece 30 is shown resting within the defensive target after it was thrown through defensive target aperture $\mathbf{15}_D$. Depending on which offensive target the defensive target is positioned adjacent to, or proximate, on playing field PF, (i.e., D1, D2, or D3, as shown in FIG. 5) this throw is either worth −3, −5, or −7 points, respectively. Additionally, when the game piece is throw through the target aperture of any defensive target, the respective throwing team will also lose the remainder of their turn in addition to obtaining the aforementioned points.

As described supra, offensive playing surface $\mathbf{14}_O$ will have a different graphical configuration (i.e., a first graphical configuration of a football player's torso and/or upper body, including, but not limited to, jersey numbers, colors, logos, designs, etc.) than defensive playing surface $\mathbf{14}_D$ (i.e., a second graphical configuration of a football player's torso and/or upper body, including, but not limited to, jersey numbers, colors, logos, designs, etc.), thereby indicating to players which of the targets score points (i.e., offensive) and which of the targets deduct points (i.e., defensive).

It will be appreciated that various aspects of the present invention described supra, and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE NUMERALS

100 Game piece tossing game
10 Target
10*a* First target
10*b* Second target
10*c* Third target
11 First end

12 Second end
13 Target board
14 Playing surface
14' Jersey indicia configuration
14" Helmet indicia configuration
14*a* Mounting surface
14*b* First arm indicia
14*c* Second arm indicia
14*d* First hand indicia portion
14*e* Second hand indicia portion
$\mathbf{14}_O$ Offensive playing surface
$\mathbf{14}_D$ Defensive playing surface
Target aperture
$\mathbf{15}_O$ Offensive target aperture
$\mathbf{15}_D$ Defensive target aperture
16 Base
16*a* Member
16*b* Member
16*c* Member
16*d* Member
16*e* Internal space
17*a* Riser
17*b* Riser
17*c* Medial riser
20*a* Fourth target
20*b* Fifth target
20*c* Sixth target
20*d* Seventh target
20*e* Eighth target
20*f* Ninth target
20*g* Tenth target
30 First game piece
31 Second game piece
32 Third game piece
33 Fourth game piece
50 Player
51 Player
500 Method for playing a game piece tossing game
501 Step 1 of method 500
502 Step 2 of method 500
503 Step 3 of method 500
504 Step 4 of method 500
505 Step 5 of method 500
506 Step 6 of method 500
507 Step 7 of method 500
508 Step 8 of method 500
509 Step 9 of method 500
510 Step 10 of method 500
511 Step 11 of method 500
512 Step 12 of method 500
G Ground
PF Playing field
SL Starting line
α Angle

What is claimed is:

1. A game piece tossing game, comprising:

a first plurality of offensive game targets, where each of said offensive targets comprises a playing surface and a target aperture within said playing surface;

a second plurality of defensive game targets, where each of said defensive targets comprises a playing surface; and, at least one game piece, arranged to be tossed toward said playing surface of at least one of said offensive game targets and toward said target aperture within said playing surface of said at least one of said offensive game targets, wherein said first plurality of offensive game targets and said second plurality of defensive game targets are arranged on a playing field; and a starting line on said playing field, wherein said starting line may be real or imaginary, wherein said starting line defines a position behind which said game piece will be is tossed toward said offensive game targets by a player.

2. The game piece tossing game recited in claim 1 wherein each of said second plurality of defensive game targets comprise a target aperture within said playing surface.

3. The game piece tossing game recited in claim 1 wherein said game piece is a beanbag.

4. The game piece tossing game recited in claim 1 wherein said game piece is selected from a group consisting of balls, pucks, rings, horseshoes, darts and flying discs.

5. The game piece tossing game recited in claim 1 wherein each of said plurality of offensive game targets is placed at a different distance from said starting line.

6. The game piece tossing game recited in claim 5 wherein a first offensive game target is arranged at a first distance from said starting line and a second offensive game target is arranged at a second distance from said starting line, where said second distance is greater than said first distance, and more points are awarded for tossing said game piece onto said playing surface or said aperture of said second offensive target than onto said playing surface or said aperture of said first offensive target.

7. The game piece tossing game recited in claim 1 wherein said player is penalized by losing points when he tosses said game piece onto said playing surface or into said aperture of said at least one defensive game target.

8. The game piece tossing game recited in claim 1 wherein there are more defensive game targets than offensive game targets.

9. A method for playing a game piece tossing game, the method comprising the steps of:

(1) assigning at least one player to a first team;

(2) assigning at least one player to a second team;

(3) placing a plurality of offensive targets into a plurality of positions on a playing field relative to a starting line on said playing field, each of said plurality of offensive targets having a target aperture and a target surface;

(4) placing a plurality of defensive targets into a plurality of positions on said playing field, each of said plurality of defensive targets having a target aperture and a target surface, said plurality of defensive targets is greater than said plurality of offensive targets;

(5) determining which of the first team and the second team is a first throwing team and a second throwing team;

(6) throwing at least one game piece from said starting line by said first throwing team toward said plurality of offensive targets and said plurality of defensive targets, preferably towards said plurality of offensive targets;

(7) calculating a score of said first throwing team based on which of said target aperture and said target surface of said plurality of offensive targets and said defensive targets said at least one game piece is thrown through or on;

(8) throwing at least one game piece from said starting line by said second throwing team toward said plurality of offensive targets and said plurality of defensive targets, preferably towards said plurality of offensive targets;

(9) calculating a score of said second throwing team based on which of said target aperture and said target surface of said plurality of offensive targets and said defensive targets said at least one game piece is thrown through or on;

(10) repeating steps (6) through (9) at least once;

(11) adding the scores of step (7) to determine a total score of said first throwing team and adding the scores of step (9) to determine a total score of said second throwing team; and,

(12) comparing the total score of said first throwing team and the total score of said second throwing team to determine a winner.

10. The method for playing a game piece tossing game recited in claim 9, wherein:

said plurality of offensive targets comprises three offensive targets;

said plurality of defensive targets comprises four defensive targets; and, said at least one game piece comprises four game pieces.

11. The method for playing a game piece tossing game recited in claim 10, wherein:

step (6) further comprises throwing each of said four game pieces by said at least one player of said first team of said first throwing team; and, step (8) further comprises throwing each of said four game pieces by said at least one player of said second team of said second throwing team.

12. The method for playing a game piece tossing game recited in claim 10, wherein step (3) further comprises:

placing one of said three offensive targets at a short position relative to said starting line;

placing one of said three offensive targets at a medium position relative to said starting line; and, placing one of said three offensive targets at a long position relative to said starting line.

13. The method for playing a game piece tossing game recited in claim 12, wherein:

said playing surface of said offensive target at said short position is worth 1 point and said target aperture of said offensive target at said short position is worth 3 points;

said playing surface of said offensive target at said medium position is worth 2 points and said target aperture of said offensive target at said medium position is worth 5 points; and, said plating surface of said offensive target at said long position is worth 3 points and said target aperture of said offensive target at said long position is worth 7 points.

14. The method for playing a game piece tossing game recited in claim 9, wherein said plurality of positions of said plurality of defensive targets on said playing field is proximate at least one of said plurality of offensive targets.

15. The method for playing a game piece tossing game recited in claim 14, wherein:

said plurality of offensive targets comprises three offensive targets;

said plurality of defensive targets comprises four defensive targets; and, said at least one game piece comprises four game pieces.

16. The method for playing a game piece tossing game recited in claim 15, wherein step (3) further comprises:

placing one of said three offensive targets at a short position relative to said starting line;

placing one of said three offensive targets at a medium position relative to said starting line; and, placing one of said three offensive targets at a long position relative to said starting line.

17. The method for playing a game piece tossing game recited in claim 16, wherein:

said playing surface of one of said plurality of defensive targets positioned proximate said offensive target at said short position is worth −1 point and said target aperture of said defensive target proximate said offensive target at said short position is worth −3 points;

said playing surface of one of said plurality of defensive targets positioned proximate said offensive target at said medium position is worth −2 points and said target aperture of said defensive target proximate said offensive target at said medium position is worth −5 points; and, said playing surface of one of said plurality of defensive targets positioned proximate said offensive target at said long position is worth −3 points and said target aperture of said defensive target proximate said offensive target at said long position is worth −7 points.

18. A method for playing a game piece tossing game, the method comprising the steps of:

(1) placing a plurality of offensive targets into a plurality of positions on a playing field relative to a starting line on said playing field, each of said plurality of offensive targets having a target surface and each target surface having a target aperture therein;

(2) placing a plurality of defensive targets into a plurality of positions on said playing field, each of said plurality of defensive targets having a target surface, wherein said plurality of defensive targets is greater than said plurality of offensive targets;

(3) throwing at least one game piece from behind said starting line toward said plurality of offensive targets; and, (4) calculating a score based upon the placements of said thrown game piece on each of said offensive and defensive targets.

19. The method for playing a game piece tossing game recited in claim 18 wherein points are scored for throwing said game piece onto said surface of one of said offensive targets and points are deducted for throwing said game piece onto said surface of one of said defensive targets.

20. The method for playing a game piece tossing game recited in claim 19 wherein more points are scored for throwing a game piece into said aperture of said surface of one of said offensive targets than for throwing said game piece onto said surface of one of said offensive targets.

21. The method for playing a game piece tossing game recited in claim 19 wherein said plurality of offensive targets consists of three offensive targets and said plurality of defensive targets consists of four defensive targets and said at least one game piece consists of four game pieces.

22. The method for playing a game piece tossing game recited in claim 19 wherein said plurality of offensive targets comprises three offensive targets and said plurality of defensive targets comprises four defensive targets and said at least one game piece comprises four game pieces.

23. The method for playing a game piece tossing game recited in claim 18 further comprising the steps of:

(5) repeating steps (3) through (4) at least once; and, (6) adding the scores of step (4) to determine a total score.

24. A method of scoring in a game piece tossing game of claim 18 comprising the steps of:

earning a first predetermined score when successfully tossing a game piece onto a surface of an offensive target;

earning a second predetermined score when successfully tossing a game piece into an aperture on said surface of said offensive target; and, earning a first negative score when tossing a game piece onto a surface of a defensive target.

25. The method of scoring in a game piece tossing game recited in claim 24, further comprising the step of earning a second negative score when tossing a game piece into an aperture of said surface of said defensive target.

26. The method of scoring in a tossing game recited in claim 25 wherein the absolute value of said second negative score is greater than the absolute value of said first negative score.

* * * * *